US005775930A

United States Patent [19]

Model et al.

[11] Patent Number: 5,775,930

[45] Date of Patent: Jul. 7, 1998

[54] ELECTRICAL CONNECTOR WITH LOCKING CONNECTOR POSITION ASSURANCE MEMBER

[75] Inventors: Michael Model; Edward Martin Bungo, both of Cortland, Ohio; John Marvin Chupak, West Middlesex, Pa.; Thomas Borsuck; Andreas Sikora, both of Hagen, Germany; Paul Gerhard Halbach, Wuppertal, Germany; Shao Chung Hsieh, Warren, Ohio

[73] Assignees: General Motors Corporation, Detroit, Mich.; Delphi Automotive Systems Deutschland, Wuppertal, Germany

[21] Appl. No.: 766,857

[22] Filed: Dec. 13, 1996

[51] Int. Cl.[6] ..... H01R 13/627

[52] U.S. Cl. ..... 439/352; 439/489

[58] Field of Search ..... 439/350–358, 439/489, 488

[56] References Cited

U.S. PATENT DOCUMENTS

| | | | |
|---|---|---|---|
| 4,634,204 | 1/1987 | Detter et al. | 339/91 R |
| 4,708,413 | 11/1987 | Schroeder | 439/358 |
| 4,714,433 | 12/1987 | Rider, Jr. | 439/310 |
| 4,886,466 | 12/1989 | Doherty et al. | 439/191 |
| 4,906,203 | 3/1990 | Margrave et al. | 439/188 |
| 4,906,204 | 3/1990 | Metzger | 439/352 |
| 4,946,395 | 8/1990 | Cope et al. | 439/352 |
| 4,946,402 | 8/1990 | Fink et al. | 439/274 |
| 4,950,175 | 8/1990 | Plyler et al. | 439/274 |
| 4,963,103 | 10/1990 | Fink et al. | 439/352 |
| 4,971,580 | 11/1990 | Ward et al. | 439/595 |
| 4,984,998 | 1/1991 | Duncan et al. | 439/352 |
| 5,026,298 | 6/1991 | Brussalis et al. | 439/358 |
| 5,120,240 | 6/1992 | Reider | 439/352 |
| 5,236,373 | 8/1993 | Kennedy | 439/347 |
| 5,252,092 | 10/1993 | Reider et al. | 439/595 |
| 5,257,944 | 11/1993 | Kennedy | 439/347 |
| 5,308,261 | 5/1994 | Kightlinger | 439/358 |
| 5,330,369 | 7/1994 | Nozaki et al. | 439/489 |
| 5,435,742 | 7/1995 | Cecil, Jr. | 439/347 |
| 5,496,184 | 3/1996 | Garrett et al. | 439/79 |
| 5,498,171 | 3/1996 | Semaan | 439/352 |
| 5,507,666 | 4/1996 | Yamanashi | 439/489 |
| 5,605,471 | 2/1997 | Plyler | 439/489 |
| 5,628,648 | 5/1997 | Higgins et al. | 439/489 |

*Primary Examiner*—Hien Vu
*Attorney, Agent, or Firm*—Cary W. Brooks

[57] ABSTRACT

The invention includes first and second electrical connectors and a connector position assurance member that is lockable in a pre-staged position. A first connector includes a pivotally connected pump handle lock arm positioned to lock on to a nub on the second connector. A connector position assurance member (CPA) is constructed for slidable movement on the first connector and includes two forward reaching arms each having a stop on a lower edge that engage a shoulder positioned on the first connector when the CPA is in a pre-staged position. In this pre-staged position, a lock arm of the CPA grabs into the pump handle on the first connector. The stop, shoulder and lock arm prevent forward or backward slidable movement of the CPA from this locked pre-staged position. As the first and second connectors are mated, a ridge on the second connector engages an angled portion of the forward reaching arms causing the arms to be lifted to raise the stop above the shoulder on the first connector and allowing the connector position assurance member to be moved forward to a final assembled position. Locking nubs on the CPA and the first connector may be positioned to keep the CPA in the final assembled position.

2 Claims, 3 Drawing Sheets

ELECTRICAL CONNECTOR WITH LOCKING CONNECTOR POSITION ASSURANCE MEMBER

TECHNICAL FIELD

This invention relates to electrical connectors and more particularly to an electrical connector having a connector position assurance member.

BACKGROUND OF THE INVENTION

In designing an electrical connector system it is desirable to include a component that insures that the electrical connectors have been properly aligned and fully mated during the assembly process. An connector position assurance member (CPA) has heretofore been used for this purpose. In some cases, the CPA is inserted into the electrical connectors after they have been fully mated. If the CPA can be inserted into the electrical connectors, the electrical connectors have been properly aligned and fully mated. If the CPA cannot be inserted into the electrical connectors, the electrical connectors are improperly aligned or not fully mated.

A disadvantage of prior art connector position assurance systems has been that it is an additional piece, often relatively small, that has heretofore been manually inserted into the connectors. Occasionally the connector position assurance members are mishandled, dropped or become unengaged from a connector. The attachment of tethers to the connector position assurance members has not fully remedied assembly problems and such systems are still somewhat cumbersome.

Heretofore it has been known to provide electrical connectors with a "pump handle" lock arm. That is, a lock arm which is hinged or pivotally connected midway between its ends to a connector. In such an arrangement, the forward end of the pump handle lock arm acts as a lock and the rearward end acts as a release handle. When the release handle is depressed, the lock is pivoted out of engagement with the cooperating lock nub on the mating connector. Electrical connectors having a CPA that operates in conjunction with the pump handle lock arm are known to those skilled in the art.

The present invention provides advantages and alternatives over the prior art.

SUMMARY OF THE INVENTION

The invention includes first and second electrical connectors and a connector position assurance member that is lockable in a pre-staged position. A first connector includes a pivotally connected pump handle lock arm positioned to lock on to a nub on the second connector. A connector position assurance member (CPA) is constructed for slidable movement on the first connector and includes two forward reaching arms each having a stop on a lower edge that engage a shoulder positioned on the first connector when the CPA is in a pre-staged position. In this pre-staged position, a lock arm of the CPA grabs into the pump handle on the first connector. The stop, shoulder and lock arm prevent forward or backward slidable movement of the CPA from this locked pre-staged position. As the first and second connectors are mated, a ridge on the second connector engages an angled portion of the forward reaching arms causing the arms to be lifted to raise the stop above the shoulder on the first connector and allowing the connector position assurance member to be moved forward to a final assembled position.

Locking nubs on the CPA and the first connector may be positioned to keep the CPA in the final assembled position.

These and other objects, features and advantages of the present invention will become apparent from the following brief description of the drawings, detailed description and appended claims and drawings.

BRIEF DESCRIPTION OF THE DRAWINGS

FIG. 7 is a sectional view taken along line 7—7 of FIG. 1;

FIG. 8 is a view similar to FIG. 7 and showing a connector position assurance member in a locked pre-staged position;

FIG. 9 is a view similar to FIG. 8 and showing the connector position assurance member being unlocked by the insertion of one connector into another connector; and FIG. 10 is a view similar to FIG. 9 and showing the connector position assurance member in a final locked position.

DETAILED DESCRIPTION

Figures 1, 2:
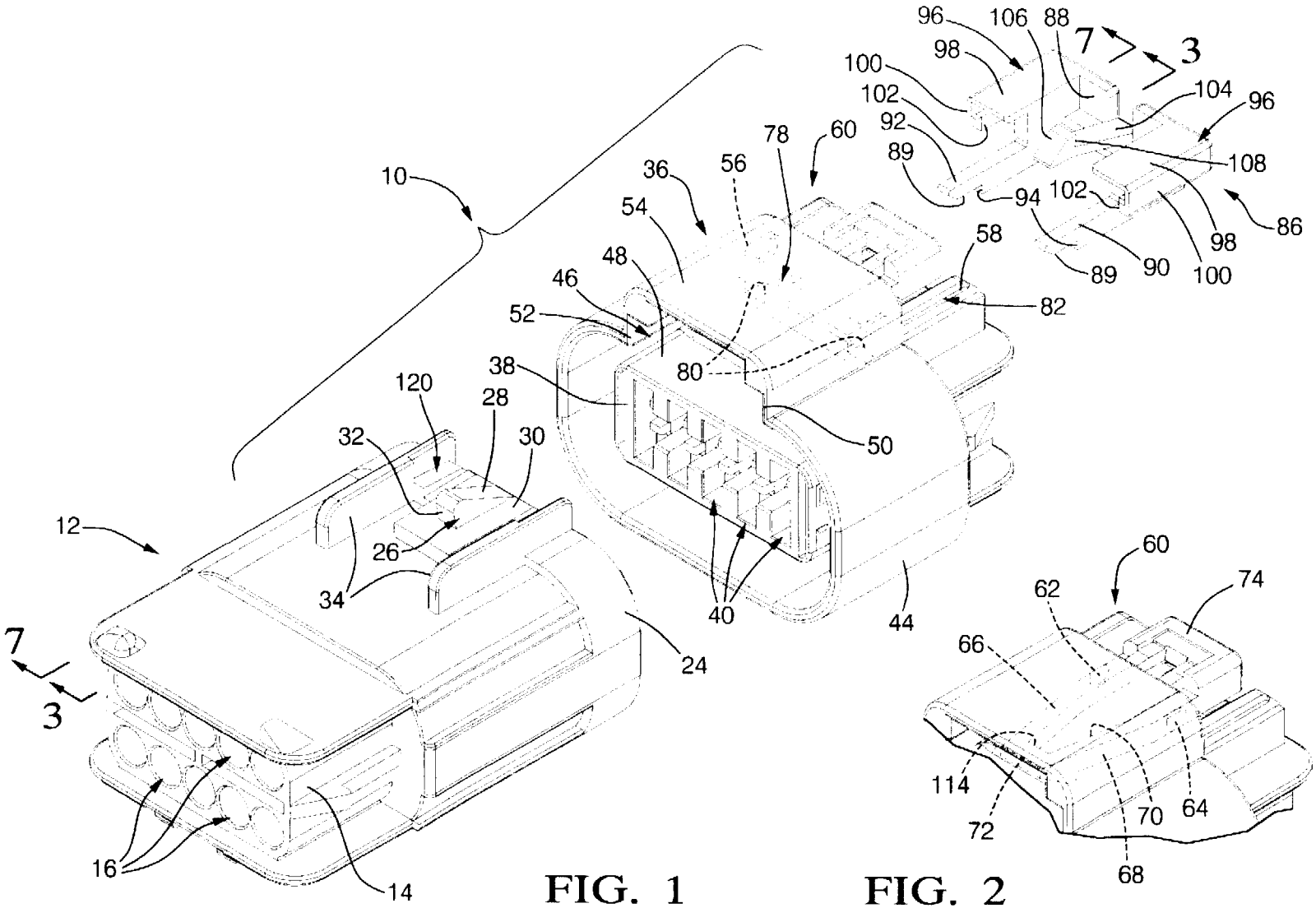
FIG. 1 is an exploded view of the present invention illustrating first and second connectors and a connector position assurance member.
FIG. 2 is a partial view of FIG. 1 showing additional details.

Referring to FIG. 1 a connector system 10 of the present invention includes a first or a plug connector 12 having a body portion 14 with a plurality of cavities 16 formed therein each for receiving a wire (not shown) and an associated metal terminal 18. The body portion 14 may have a plurality of flexible finger locks 20 extending into the cavities 16 and having hooked portions 22 for engaging recesses in the metal terminals 18 and holding the terminals in position in a manner which is known to those skilled in the art. The plug connector 12 has a shroud 24 surrounding a portion of the body portion and extending forward therefrom. A primary latch nub 26 is provided having a ramped surface 28 projecting upwardly from a top wall 30 of the shroud 24 and a locking shoulder 32 extending down from the ramped surface 28. Two spaced apart guide walls 34 extend upwardly from the top wall of the shroud and straddle the primary latch nub 26.

Figure 3:
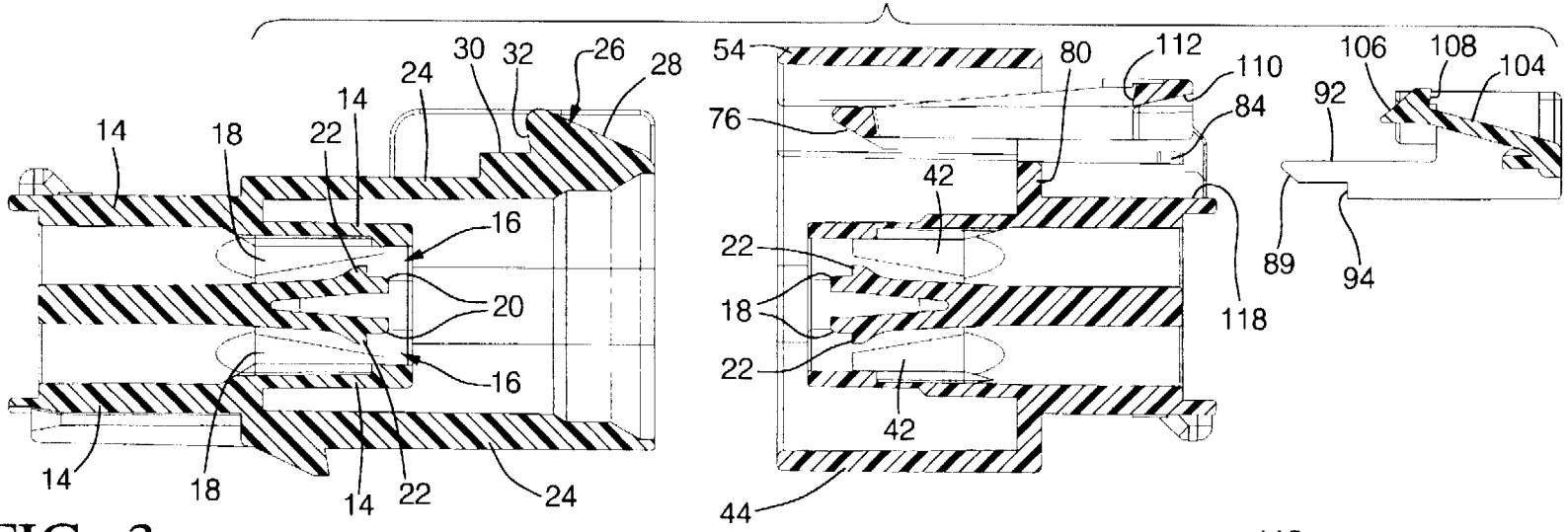
FIG. 3 is a sectional view taken along line 3—3 of FIG. 1 of a connector system according to the present invention.
Figure 4:
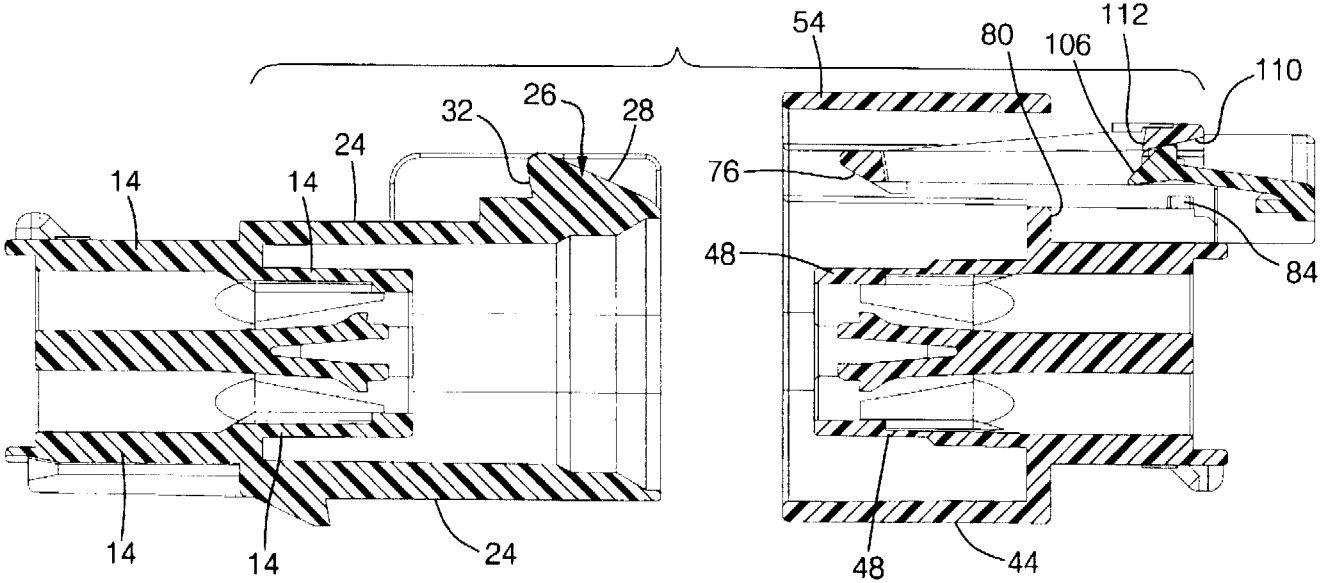
FIG. 4 is a sectional view taken along line 4—4 of FIG. 1 showing a connector position assurance member partially inserted into a connector.
Figure 5:
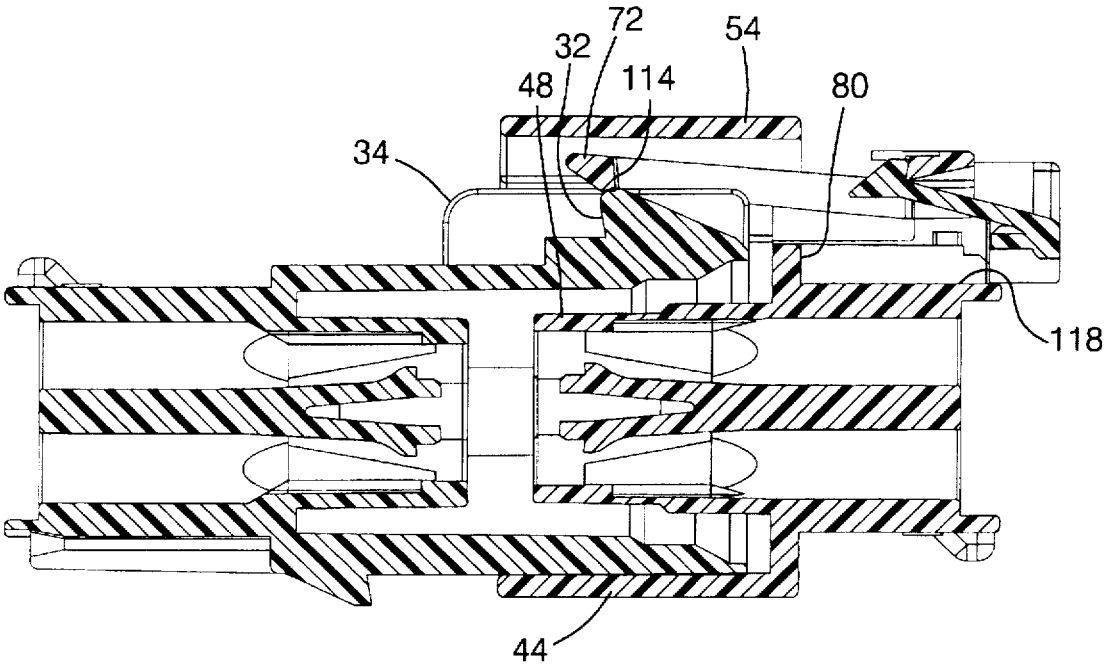
FIG. 5 is a view similar to FIG. 3 and showing a connector position assurance member inserted in a connector in a pre-staged position.
Figure 6:
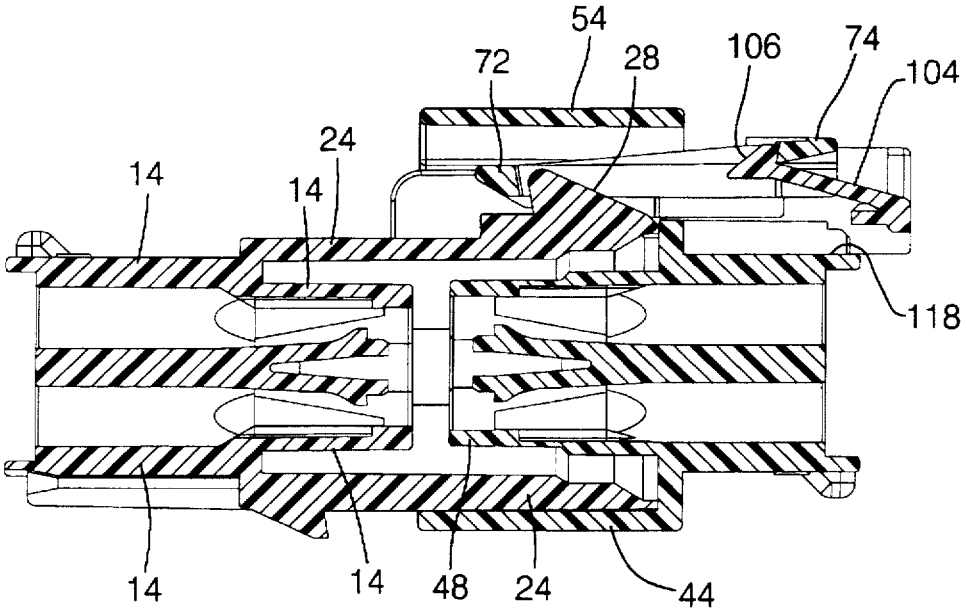
FIG. 6 is a sectional view similar to FIG. 3 and showing a pump handle lock arm of one connector latched onto another connector.

A second or female connector 36 is provided having a body portion 38 with a plurality of cavities 40 formed therein for receiving a portion of a wire (not shown) and a metal terminal 42 matable with the metal terminal 18 of the first connector (FIG. 3). The body portion 38 of the second connector also includes flexible fingers 20 and hooked portions 22 similar to those of the first connector. A shroud 44 surrounds a portion of the body portion 38 of the second connector and is constructed and arranged so that the shroud 24 of the first connector can be received inside the shroud 44 of the second connector or visa versa. The shroud 44 of the second connector does not extend all the way around the body portion 38 in that a gap 46 is centrally located over a part of the top surface 48 of the body portion 38. A pair of spaced apart support walls 50, 52 extend upwardly from the shroud at the location adjacent the gap 42 and a protective roof 54 extends between the upwardly extending support walls 50, 52. A set of spaced apart guide rails 56, 58 extend upwardly from the body portion at the rear of the shroud 44.

A primary connector lock 60 is provided and pivotally connected to the guide rails 56, 58 (extending upwardly from the body portion) by a pair of opposed torsion arms 62, 64 (FIGS. 1–2). The primary connector lock includes a pair of spaced apart fingers 66, 68 defining a slot 70 therebetween and connected together at one end by a bridge 72 and connected at the other end by a pump handle 74. The bridge 72 and a portion of the fingers 66, 68 of the primary connector lock are covered by the protective roof 54. Preferably ramped surfaces 76 are provided at the end of each of the spaced apart fingers 66, 68 at a location near the bridge 72. A guide channel 78 is defined in the body portion adjacent each of the upwardly extending guide rails 56, 58 and a shoulder 80 is formed in the body portion in the front portion of each of the channels. Guide grooves 82 are formed on the outer faces of the guide rails 56, 58 that extend upwardly from the body portion. Ramped lock bumps 84 are formed on the inside surface of the guide rails 56, 58 that extend upwardly from the body portion.

A connector position assurance member (CPA) 86 is provided having a base portion 88 and spaced apart steering arms 90, 92 extending perpendicularly from the base portion 88 and having a ramped surface 89 at the tip of each steering arm (FIGS. 1 and 3). Each steering arm has a stop 94 formed in a lower edge thereof for engaging the shoulder 80 formed in the body portion 38 of the second connector near the front of the channel. A C-shaped guide wing 96 extends outwardly from each steering arm and includes a portion 98 designed to be hung over a top edge of a guide rail 56, 58 that extends upwardly from the body portion 38. Each C-shaped guide wing 96 has a first wall 98 overhanging the top edge of a guide rail 56, 58, a second wall 100 extending down from the first wall 98 and parallel to a guide rail 56, 58. A projecting brim 102 extending inwardly from the second wall 100 toward a guide rail 56, 58. The connector position assurance member is constructed and arranged so that the projecting brim 102 of the guide rail is received in the groove 82 formed in a guide rail 56, 58 that extends upwardly from the body portion. A flexible lock finger or arm 104 extends from the base portion 88 at a location between the two steering arms 90, 92 and includes a ramped tip 106 and locking shoulder 108 extending therefrom. Once the guide wings 96 are located on the upwardly extending guide rails 56, 58, the ramped portion 106 of the flexible finger 104 engages a bottom surface 110 of the pump handle and the flexible finger is deflected downwardly until the locking shoulder 108 of the flexible finger moves pass the pump handle and the flexible finger snaps upwardly so that the locking shoulder 108 engages a front wall 112 of the pump handle (FIGS. 3–6). Simultaneously, the stop 94 on the lower edge of each steering arm 90, 92 engages the shoulder 80 formed in the body portion to lock the connector position assurance member in a pre-staged position preventing both forward and backward slidable movement (FIG. 8).

The shroud 24 of the plug connector may be inserted into the shroud 44 of the female connector so that the bridge 72 on the primary connector lock engages and rides up the ramped surface 28 of the primary latch nub 26 on the plug connector until the bridge 72 moves pass the locking shoulder 32 of the primary latch nub. The primary lock then snaps downwardly so that an inside wall 114 of the bridge engages the shoulder 32 of the primary latch nub. As the male plug is moved forward, the shroud 24 engages the ramped surfaces 89 on the tips of the steering arms 90, 92 of the CPA causing the arms to be pivoted upwardly and so that the stop 94 on the lower edge of the steering arms is lifted above the shoulder 80 formed in the body portion of the female connector (FIG. 9). At this point, the CPA can be moved forward so that the stop 94 passes the shoulder 80 and so that the ramped lock bumps 84 on the inside surface of each of the guide rails 56, 58 and ramped lock bumps 116 (see FIG. 7) on the outside surface of the steering arms that lock the CPA in a final assembled position. The components are constructed and arranged so that the CPA can only be slid forward to its final position when the plug and female connectors have been properly aligned and fully mated. In the fmal assembled position (FIG. 10), the base 88 of the CPA engages a bottom face 110 of the pump handle and a top surface 118 of the body portion of the connector, thereby preventing the pump handle from being pressed downwardly and unlatching the primary connector lock 60 from the primary latch nub 120 on the first connector either intentionally or inadvertently due to such forces of vibration that might be encountered in a vehicle.

As will be appreciated from the foregoing discussion, the present invention provides a connector assembly with a CPA which is pre-assembled to one of the connectors with no loose pieces to fumble with during assembly. The CPA according to the present invention cannot be inadvertently seated or put in a final position until the male and female connectors have been fully mated. When the CPA is in a final position, the connectors cannot be removed without first moving the CPA to its pre-staged position. The ramped lock bumps on the CPA and the first connector keep the CPA in its forward fully mated final assembled position. Further, the stop on the steering arm prevents the connector position assurance member from being fully seated until the connectors are fully mated.

We claim:

1. An electrical connector assembly comprising:

a first connector having a plurality of cavities formed therein and a latch nub on a surface, a second connector having a plurality of cavities defined therein and a primary connector lock arm elevated above a surface of the second connector for pivotal movement of the lock arm, the lock arm being slotted and defined by two spaced apart fingers and a bridge connecting the fingers at a first end and a pump handle connecting the fingers at a second end, channels being defined in the second connector intersecting a raised shoulder formed in the second connector, a connector position assurance member having a base and two spaced apart steering arms extending in the same direction from the base and having a ramped tip and constructed and arranged so that a steering arm may be slidably moved in a respective channel formed in the second connector, said steering arms having a stop defined at a lower edge so that in a first pre-staged position of the connector position assurance member, the stop on the steering arms engages the raised shoulder formed in the second connector, said shoulder preventing further forward slidable movement of the connector position assurance member, and wherein upon mating said first connector to said second connector the bridge of the primary connector lock engages the latch nub on the first connector causing the primary connector lock arm to pivot upward and ride over the nub and snap back downward so that an inside edge of the bridge engages a rear surface of the latch nub locking said first and second connectors together and simultaneously a ridge on the first connector engages the ramped tip on each of the steering arms of the connector position assurance member causing the connector position assurance member arms to be lifted up wherein the stop at the lower edge of the arms is raised above the shoulder formed in the second connector so that the connector position assurance member may be moved forward to a final locking position wherein a portion of the connector position assurance member engages an underside of the pump handle and a surface of the second connector preventing the pump handle from being depressed downward and unlocking the bridge of the primary connector lock arm from the latch nub.

2. An electrical connector assembly comprising:

a first connector having a body portion with a plurality of cavities formed therein and constructed and arranged to receive and retain a wire and an associated metal terminal, a first shroud surrounding a portion of the body portion and extending forward therefrom, a primary latch nub having a ramped surface projecting upwardly from a top wall of the first shroud and having a locking shoulder extending downwardly from the ramped surface, two spaced apart guide abutments extending upwardly from the top wall of the shroud and straddling the primary latch nub;

a second connector having a body portion with a plurality of cavities formed therein constructed and arranged for receiving and retaining a wire and metal terminal matable with the metal terminal of the first connector, a second shroud surrounding a portion of the body portion of the second connector and extending forward therefrom, the second shroud being constructed and arranged to receive a portion of the first shroud of the first connector, the second shroud not extending all the way around the body portion of the second connector so that the shroud has a gap centrally located over a part of the top of the body portion, a pair of spaced apart support rails extending upwardly from the second shroud at a location adjacent the gap and a protective roof extending between the upwardly extending support walls, a set of spaced apart guide walls extending upwardly from the body portion behind the second shroud, a primary connector lock pivotally connected to the guide rails extending upwardly from the body portion by a pair of opposed torsion arms, the primary connector lock including a pair of spaced apart fingers defined by a slot therebetween and connected at one end by a bridge and connected at the other end by a pump handle, the bridge and a portion of the fingers of the primary connector lock being covered by the protective roof, a pair of spaced apart guide channels formed in the body portion each being adjacent a respective upwardly extending guide rail and a shoulder formed in the body portion in the front portion of each of the channels, guide grooves formed on the outer surface of the guide rails and ramped lock bumps formed on an inside surface of the guide wall, a connector position assurance member having a base portion and spaced apart steering arms extending perpendicularly from the base portion, each steering arm having a stop formed on the lower edge thereof for engaging the shoulder formed in the body portion of the second connector near the front of the channel, a C-shaped overhanging guide wing extending outwardly from each steering arm including a portion designed to be hung over a top edge of the guide rail extending upwardly from the body portion, each C-shaped guide wing having a first wall overhanging the top edge of the guide rail, a second wall extending downwardly from the first wall and parallel to the guide rail and a brim extending inwardly from the second wall towards the guide rail, the connector position assurance member being constructed and arranged so that the inwardly extending brim of the guide wing is received in the groove formed in an associated guide rail extending upwardly from the body portion, a flexible lock finger extending from the base portion at a location between the two steering arms and including a ramped tip and locking shoulder extending therefrom, so that the connector position assurance member can be assembled to the second connector by inserting the steering arms into the guide channels so that the ramped portion of a flexible finger engages a lower edge of the pump handle and the flexible finger is deflected downwardly until the locking shoulder of the flexible finger moves passed the pump handle and the flexible finger snaps upwardly and the locking shoulder engages a front wall of the pump handle and simultaneously the stop of the steering arm engages the shoulder formed in the body portion to lock the connector position assurance member in a pre-staged position preventing forward and backward slidable movement, and so that the first and second connectors may be properly aligned and mated together wherein the shroud of the first connector is inserted into the second shroud and the bridge of the primary connector lock engages and rides up the ramped surface of the primary lock nub on the first connector until the bridge moves passed the locking shoulder of the primary latch nub and the primary lock snaps down so that the inside wall of the bridge engages the shoulder of the primary latch nub, and so that the shroud engages ramped surfaces on the tip of the steering arms causing the arms to be pivoted upwardly and so that the stop on the lower edge of the steering arm is raised above the shoulder formed in the body portion of the female connector, allowing the connector position assurance member to be moved forward so that the stop passes the shoulder and the ramped lock nubs on the inside surface of each of the guide wings and the outside surface of the steering arms move pass each other to a locked position and so that the connector position assurance member is a final assembled position wherein a portion of the connector position assurance member engages a lower edge of the pump handle and a top surface of the body portion of the connector preventing the pump handle from being depressed downwardly and unlatching the primary connector lock from the primary latch nub on the first connector.

* * * * *